US007133008B2

(12) United States Patent
Naganuma

(10) Patent No.: US 7,133,008 B2
(45) Date of Patent: Nov. 7, 2006

(54) DRIVE METHOD AND DRIVE APPARATUS FOR A DISPLAY PANEL

(75) Inventor: Hideo Naganuma, Fukuroi (JP)

(73) Assignees: Pioneer Corporation, Tokyo-to (JP); Pioneer Display Products Corporation, Shizuoka-ken (JP)

( * ) Notice: Subject to any disclaimer, the term of this patent is extended or adjusted under 35 U.S.C. 154(b) by 118 days.

(21) Appl. No.: 10/174,821

(22) Filed: Jun. 20, 2002

(65) Prior Publication Data

US 2003/0001804 A1 Jan. 2, 2003

(30) Foreign Application Priority Data

Jun. 28, 2001 (JP) ..... P2001-197294

(51) Int. Cl.
*G09G 3/28* (2006.01)

(52) U.S. Cl. ..... 345/63; 345/77; 345/94; 345/211

(58) Field of Classification Search ..... 345/63, 345/64, 76, 77, 94, 211
See application file for complete search history.

(56) References Cited

U.S. PATENT DOCUMENTS 4,779,593 A * 10/1988 Kiernan ..... 607/65
5,093,654 A * 3/1992 Swift et al. ..... 345/76
5,835,072 A 11/1998 Kanazawa
5,956,014 A 9/1999 Kuriyama et al.
6,069,450 A * 5/2000 Sakai et al. ..... 315/169.1
6,400,346 B1 * 6/2002 Kasahara et al. ..... 345/63
6,466,186 B1 10/2002 Shimizu et al.
2004/0030632 A1 * 2/2004 Hausman

FOREIGN PATENT DOCUMENTS

JP 11-305722 11/1999
JP 2000-172223 6/2000

* cited by examiner

*Primary Examiner*—Richard Hjerpe
*Assistant Examiner*—Jean Lesperance
(74) *Attorney, Agent, or Firm*—Sughrue Mion, PLLC

(57) ABSTRACT

This invention provides a drive method and an drive apparatus for a display panel that continuously maintain good image quality when the display panel is used for a long period of time. Based on the image data that are output from the A/D converter, an APL (Average Picture Level) calculation unit calculates the average brightness level for one field, and then a total light emission calculation unit uses the APL calculates the total number of times light is emitted. Based on the total light emissions or the total usage time, the control unit controls the voltage of drive pulses for the X-sustain driver and Y-sustain driver, or the timing at which they are applied, in order to compensate for changes over time of the PDP.

10 Claims, 8 Drawing Sheets

DRIVE METHOD AND DRIVE APPARATUS FOR A DISPLAY PANEL

BACKGROUND OF THE INVENTION

1. Field of the Invention

This invention relates to a drive method and drive apparatus for a display panel, which based on an input image signal, selectively applies a plurality of drive pulses that correspond to the gradation of the image.

2. Description of the Related Art

In recent years, much attention has been placed on display devices such as plasma display panels, and there is much expectation that the displays will be made larger and thinner. In the video display devices that use these kinds of display devices, it is necessary to maintain stable image characteristics for a long period of time. Generally, it is assumed that the life of a plasma display is about 3,000 to 5,000 hours, so it is desired that the discharge characteristics of the plasma display panel be kept uniform during this time in order to maintain good image quality.

However, when light is repeatedly emitted from the discharge cells of the plasma display panel over a long period of time, the resulting change in the discharge characteristics cannot be avoided. For example, when a plasma display is used for a long period of time and the discharge voltage of the discharge cells drops making it impossible to emit enough light, the image quality of the display screen becomes poor. Therefore, when using a display such as a plasma display panel, even though the image quality is initially good, there is a problem in that it is difficult to continuously maintain good image quality due to changes that occur from use over a long period of time.

SUMMARY OF THE INVENTION

Taking the aforementioned problem into consideration, it is the object of this invention to provide a drive method for a display panel that is capable of continuously maintaining good image quality when using the display panel for a long period of time, by properly controlling the drive amount according to changes over time of the display characteristics of the display panel.

The above object of the present invention can be achieved by a video signal transmission method of the present invention. A drive method for a display panel that selectively applies a plurality of drive pulses corresponding to the gradation of an image based on an input image signal, said method is provided with: a calculation process of finding the number of times light is emitted within a specified amount of time for each cell of said display panel, and totaling the number of light emissions to calculate the total number of light emissions; and a control process of controlling the specified amount of drive for said display panel based on said total number of light emissions in order to compensate for change over time of said display panel.

According to the present invention, the total number of times that light is emitted in correspondence to the multiple drive pulses applied is calculated, and the amount of drive for the display panel is controlled based on the obtained total number of time light is emitted, and in this way the change over time of the display panel is compensated for. Therefore, when continuously using the display panel over a long period of time, it is possible to stably maintain the light emitting characteristics by properly controlling the amount of drive, and to effectively prevent degradation of image quality, even when the light emitting characteristics change over time.

The above object of the present invention can be achieved by a video signal transmission method of the present invention. A drive method for a display panel that selectively applies a plurality of drive pulses corresponding to the gradation of an image based on an input image signal, said method is provided with: a detection method of totaling the amount of time said display panel is used and detecting the total usage time; and a control method of controlling the specified amount of drive for said display panel based on said total usage time in order to compensate for change over time of said display panel.

According to the present invention, the amount of time that the display panel is used is totaled, and the amount of drive for the display panel is controlled based on the obtained total amount of time used, and in this way the change over time of the display panel is compensated for. Therefore, when continuously using the display panel over a long period of time, it is possible to stably maintain the light emitting characteristics by properly controlling the amount of drive, and to effectively prevent degradation of image quality, even when the light emitting characteristics change over time.

In one aspect of the present invention, the drive method for a display panel of the present invention is wherein the voltage of said drive pulses for said display panel is controlled.

According to the present invention, the voltage of the drive pulse that is applied to the display panel is controlled based on the aforementioned total number of times light is emitted or the total amount of time the display panel is used, so it is possible to counter any changes to the light emitting characteristics of the display panel by increasing or decreasing the voltage and to effectively prevent degradation of the image quality.

In another aspect of the present invention, the drive method for a display panel of the present invention is wherein the timing at which said drive are applied to said display panel is controlled.

According to the present invention, the timing for applying the drive pulse to the display panel is controlled based on the aforementioned total number of times light is emitted or the total amount of time the display panel is used, so it is possible to counter any changes to the light emitting characteristics of the display panel by adjusting the timing for applying the drive pulse and to effectively prevent degradation of the image quality.

In further aspect of the present invention, the drive method for a display panel of the present invention is wherein: said calculation method of calculating the total number of light emission multiplies the average brightness of said image in one field by the total number of said drive pulses in one field, and totals the found number of light emissions to calculate said total number of light emissions.

According to the present invention, when the total number of times that light is emitted is calculated, the average brightness level is found for each field from the input image signal, and the average brightness value of the field is multiplied by the total number of drive pulses and the multiplication results are totaled, so it is possible to easily obtain the total number of times light is emitted from the image signal, and thus it is possible to compensate for change over time of the display panel using efficient processing.

The above object of the present invention can be achieved by a video signal transmission apparatus of the present invention. A drive apparatus for a display panel that selectively applies a plurality of drive pulses corresponding to the gradation of an image based on an input image signal, said apparatus is provided with: a calculation device for finding the number of times light is emitted within a specified amount of time for each cell of said display panel, and totaling the number of light emissions to calculate the total number of light emissions; and a control device for controlling the specified amount of drive for said display panel based on said total number of light emissions in order to compensate for change over time of said display panel.

According to the present invention, the total number of times that light is emitted in correspondence to the multiple drive pulses applied is calculated, and the amount of drive for the display panel is controlled based on the obtained total number of time light is emitted, and in this way the change over time of the display panel is compensated for. Therefore, when continuously using the display panel over a long period of time, it is possible to stably maintain the light emitting characteristics by properly controlling the amount of drive, and to effectively prevent degradation of image quality, even when the light emitting characteristics change over time.

The above object of the present invention can be achieved by a video signal transmission apparatus of the present invention. A drive apparatus for a display panel that selectively applies a plurality of drive pulses corresponding to the gradation of an image based on an input image signal, said apparatus is provided with: a detection device for totaling the amount of time said display panel is used and detecting the total usage time; and a control device for controlling the specified amount of drive for said display panel based on said total usage time in order to compensate for change over time of said display panel.

According to the present invention, the amount of time that the display panel is used is totaled, and the amount of drive for the display panel is controlled based on the obtained total amount of time used, and in this way the change over time of the display panel is compensated for. Therefore, when continuously using the display panel over a long period of time, it is possible to stably maintain the light emitting characteristics by properly controlling the amount of drive, and to effectively prevent degradation of image quality, even when the light emitting characteristics change over time.

In one aspect of the present invention, the drive apparatus for a display panel of the present invention is wherein the voltage of said drive pulses for said display panel is controlled.

According to the present invention, the voltage of the drive pulse that is applied to the display panel is controlled based on the aforementioned total number of times light is emitted or the total amount of time the display panel is used, so it is possible to counter any changes to the light emitting characteristics of the display panel by increasing or decreasing the voltage and to effectively prevent degradation of the image quality.

In another aspect of the present invention, the drive apparatus for a display panel of the present invention is wherein the timing at which said drive are applied to said display panel is controlled.

According to the present invention, the timing for applying the drive pulse to the display panel is controlled based on the aforementioned total number of times light is emitted or the total amount of time the display panel is used, so it is possible to counter any changes to the light emitting characteristics of the display panel by adjusting the timing for applying the drive pulse and to effectively prevent degradation of the image quality.

In further aspect of the present invention, the drive apparatus for a display panel of the present invention is wherein: said calculation device for calculating the total number of light emission multiplies the average brightness of said image in one field by the total number of said drive pulses in one field, and totals the found number of light emissions to calculate said total number of light emissions.

According to the present invention, when the total number of times that light is emitted is calculated, the average brightness level is found for each field from the input image signal, and the average brightness value of the field is multiplied by the total number of drive pulses and the multiplication results are totaled, so it is possible to easily obtain the total number of times light is emitted from the image signal, and thus it is possible to compensate for change over time of the display panel using efficient processing.

DESCRIPTION OF THE PREFERRED EMBODIMENT

The preferred embodiment of the invention is explained below based on the drawings. In this embodiment, the invention is applied to a video display apparatus that uses a plasma display panel.

Figure 1:
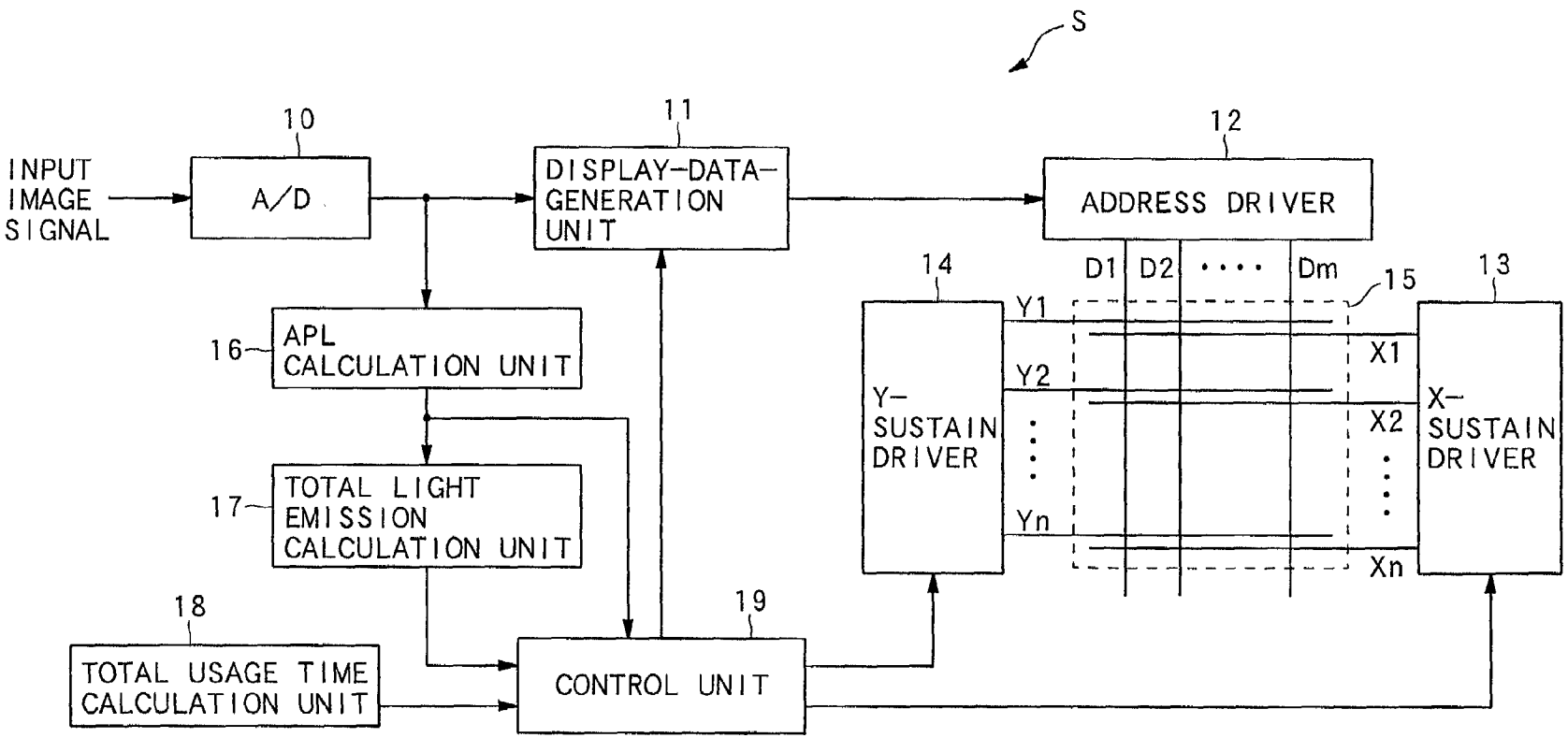
FIG. 1 is a block diagram showing the main construction of the video display apparatus of an embodiment of the invention.

FIG. 1 is a block diagram showing the major construction of the video display apparatus of this embodiment. The video display apparatus shown in FIG. 1 comprises: an A/D converter 10, display-data-generation unit 11, address driver 12, X-sustain driver 13, Y-sustain driver 14, PDP 15, APL calculation unit 16, total light emission calculation unit 17, total usage time calculation unit 18 and control unit 19.

In the construction described above, the A/D converter 10 synchronizes the input analog image signal with a specified timing signal and digitizes the signal to convert it to digital image data. The image data that are output from the A/D converter 10 are a plurality of picture element data that are arranged to make of the display screen and, 8 bits for example, are allotted for each picture element data.

The display-data-generation unit 11 stores the image data that are output from the A/D converter 10, and properly adjusts the brightness, gamma correction, and gradation for each field, and generates display data that conforms to the sub-field method, which is a method for driving the PDP 15 and which will be described later. The display-data-generation unit 11, output the display data to be displayed to the address driver 12 at timing that is specified by the control unit 19.

Based on the display data of the display screen, the address driver 12 generates data pulses that correspond to the picture element data and that are to be applied to the 'm' number of address terminals D1 to Dm on the PDP 15. Also, the X-sustain driver 13 generates reset pulses and sustain pulses, as drive pulses to be applied to an 'n' number of sustain terminals X1 to Xn on the PDP 15 at a specified timing. Similarly, the Y-sustain driver 14 generates reset pulses, scanning pulses and sustain pulses, as drive pulses to be applied to an 'n' number of sustain terminals Y1 to Yn on the PDP 15 at a specified timing.

The PDP 15 is a display device having 3-electrode surface discharge construction in which sustain electrodes X1 to Xn and sustain electrodes Y1 to Yn are arranged parallel in the area corresponding to the display screen, and where address electrodes D1 to Dm are cross them. Also, the layer of the PDP 15 in which the 3 electrodes are formed is covered by a dielectric surface to form a discharge space, and a discharge cell that corresponds to one picture element is formed at each electrode intersection, and by applying pulses corresponding to the display data, it is possible to display a desired image on the PDP 15.

Figure 2:
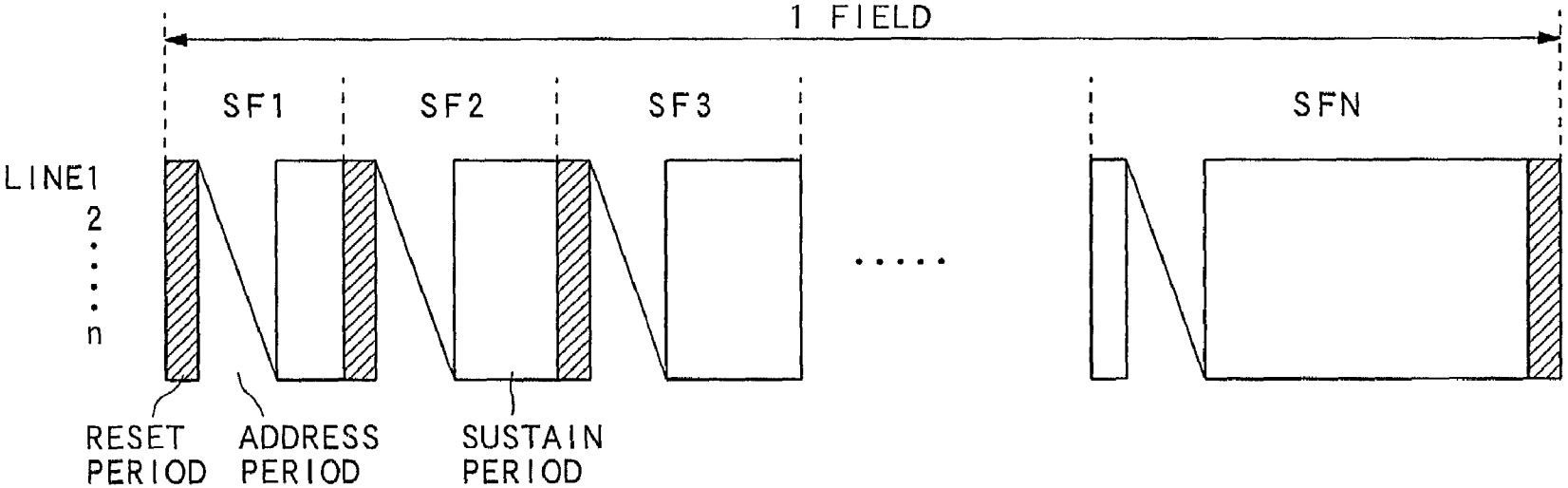
FIG. 2 is a drawing that explains the drive method for a plasma display panel (PDP) based on the sub-field method, and it shows the state where each field comprises N number of sub-fields.

Next, the method for driving the PDP 15, based on the sub-field method, will be explained using FIG. 2 and FIG. 3 as a reference. In the video display apparatus of this embodiment, in order to perform gradation representation of the video, one field is divided into a plurality of sub-fields, and address discharge and sustain discharge is performed in each sub-field to drive the PDP 15. Generally, in the NTSC format, thirty image frames are formed per second, and since there are two fields in one frame, this corresponds to sixty fields per second. As shown in FIG. 2, each field comprises 'N' number of sub-fields (SF), and each sub-field comprises a reset period, address period and sustain period. Also, the length of the sustain period starting from the first sub-field to the Nth sub-field is gradually increased so that it is possible to apply the specified number of sustain pulses corresponding to the brightness desired for a discharge cell.

Figure 3:
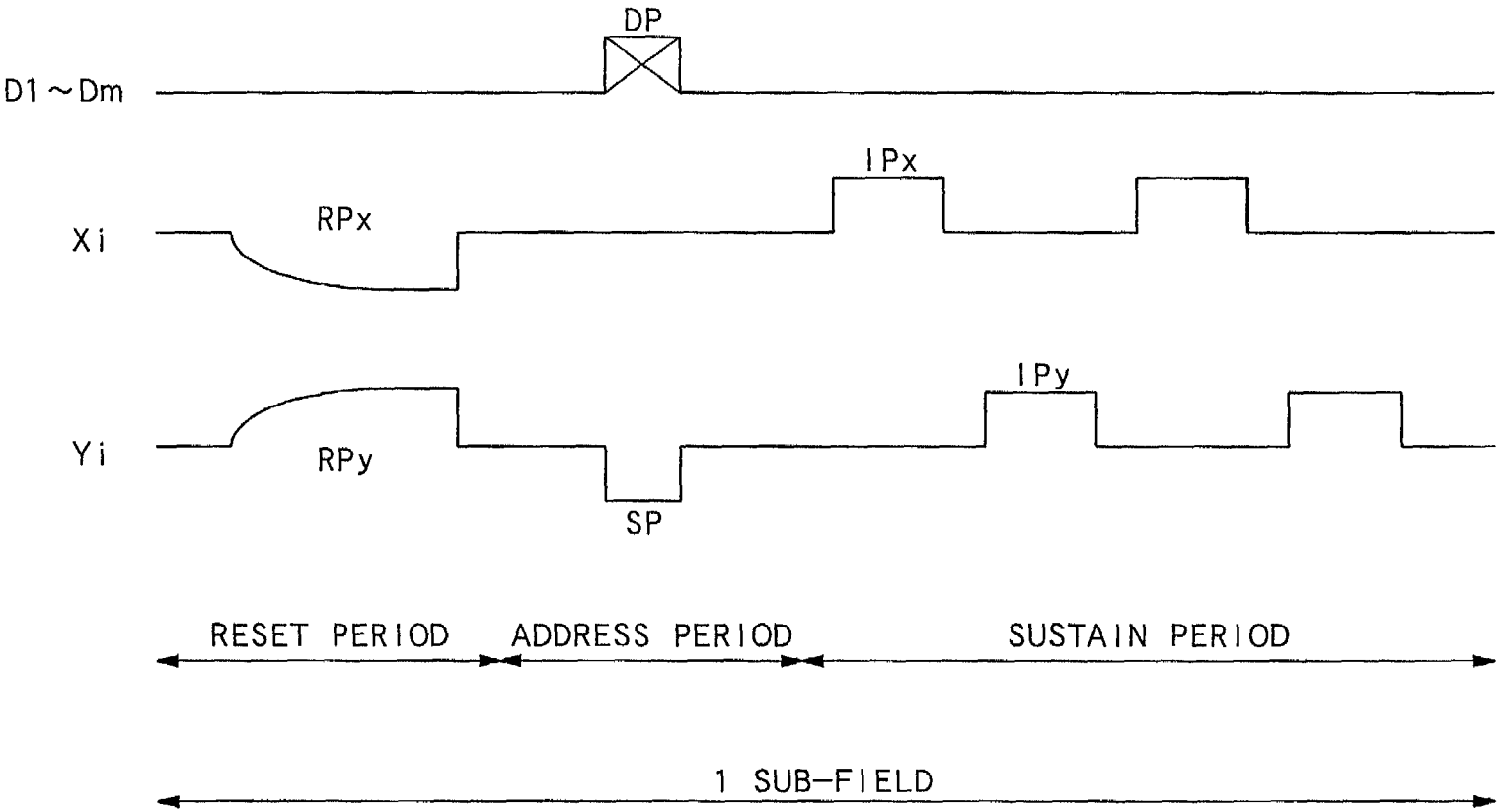
FIG. 3 is a drawing that explains the drive method for a plasma display panel (PDP) based on the sub-field method, and it shows the waveform pattern of the pulses that are applied during the sub-field reset period, the address period and the sustain period.

FIG. 3 shows the waveform pattern of the pulses that correspond to the ith sustain electrode Xi and sustain electrode Yi and that are applied during the reset period, address period and sustain period. First, in the reset period, a negative voltage reset pulse RPx is applied to the sustain electrode Xi, while at the same time, a positive voltage reset pulse RPy is applied to the sustain electrode Yi. When this happens, reset discharge occurs at the same time for all of the discharge cells, and the reset discharge is finished, a specified amount of barrier charge is generated in each discharge cell.

Next, during the address period, a negative-voltage scanning pulse SP is applied to the sustain electrode Yi at the timing when high-voltage or low-voltage data pulses DP are applied to the address electrodes D1 to Dm. At this time, through the action of a selected blocking discharge, when a scanning pulse SP is applied, a discharge occurs in a discharge cell to which a high-voltage data pulse DP is applied, and the barrier change is removed. On the other hand, in a discharge cell to which a low-voltage data pulse DP is applied, no discharge occurs when a scanning pulse SP is applied, so the barrier charge is maintained.

Next, during the sustain period, a positive-voltage sustain pulse IPx is applied to the sustain electrode Xi, and after a specified interval, a positive-voltage sustain pulse IPy is applied to the sustain electrode Yi. Each time the sustain pulse IPx and sustain pulse IPy are alternately applied in this way, electro luminescence repeatedly occurs in the discharge cells in which the barrier charge remains. Here, when the video display apparatus is used for a long period of time, degradation of the image quality of the PDP 15 occurs due to change over time of the discharge characteristics of the discharge cells. Therefore, in this embodiment, as will be described later, the value of the voltages on the sustain pulses IPx, IPy and the timing at which they are applied is controlled to compensate for change over time of the discharge characteristics of the discharge cells. The method will be described in detail later.

Next, in FIG. 1, for the image data that are output from the A/D converter 10, the APL calculation unit 16 calculates the APL (Average Picture Level), which is the average brightness level for the image data for each field. When the brightness level range is expressed as 0 to 1, the APL value approaches 0 for a black display screen, and approaches 1 for a white display screen. The APL value that is calculated by the APL calculation unit 16 is then output to the total light emission calculation unit 17 and the control unit 19.

The total light emission calculation unit 17 finds the total number of times that light is emitted in the PDP 15 for each field based on the aforementioned APL value, and from that, calculates the total number of times light has been emitted. The total number of times that light is emitted in the PDP 15 for each field is found by multiplying the total number of sustain pulses K in one field by the aforementioned APL value. The total number of sustain pulses K in one field is the total number of sustain pulses K1 to KN that correspond to the weighting given to the respective sub-fields. Also, in the case of the video display apparatus of this embodiment it is assumed that there is a function for limiting the brightness level, so the total number of sustain pulses K is determined according to the preset ABL (Automatic Brightness Limiter).

Figure 4:
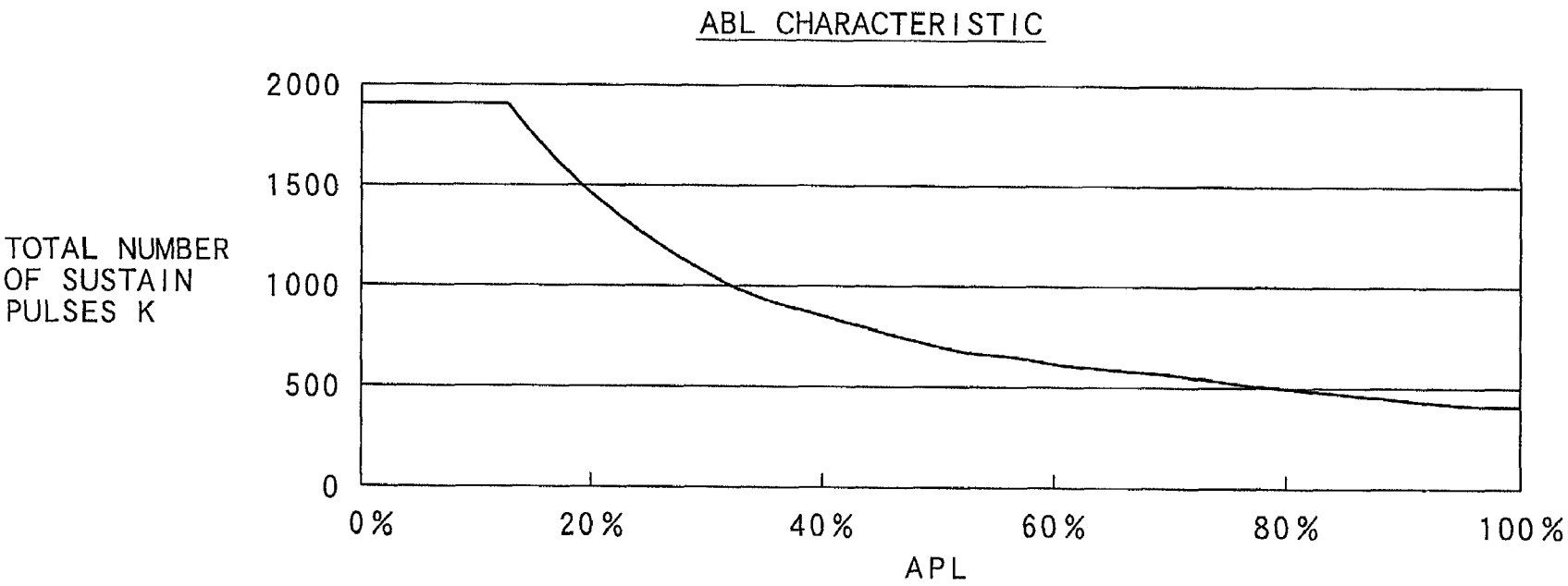
FIG. 4 is a drawing that shows an example of the ABL characteristics.

FIG. 4 shows one example of the aforementioned ABL characteristics. In FIG. 4, the APL value is expressed as a percentage and is shown along the horizontal axis and the total number of sustain pulses K for one field is shown along the vertical axis. As shown in FIG. 4, when the APL value is above a specified value, the brightness is limited by gradually decreasing the total number of sustain pulses K as the APL value increases. By limiting the brightness of the display screen according to the total number of sustain pulses K in this way, it is possible to keep the consumed power to a minimum while maintaining the proper brightness for the display screen.

The total number of light emissions for one field that is found from the multiplied product of the total number of sustain pulses K, which is based on the ABL characteristics, and the APL value, is added to the total number of light emissions that is held in the total light emission calculation unit 17, and in this way the total number of times light is emitted is continuously updated. This total number of times light is emitted can be held in a non-volatile memory for example. The total number of times light is emitted, which is held in the total light emission calculation unit 17, is output to the control unit 19 so that it can be used for drive control that will be explained later.

On the other hand, the total usage time calculation unit 18 detects the total amount of time the video display apparatus has been used. The total usage time calculation unit 18 uses a clock (not shown in figure) for detecting when the power supply to the video display apparatus is turned ON and the amount of time the PDP 15 is driven, and the saved total amount of time the display is used is continuously updated by referencing the clock output. The total usage time that is detected by the total usage time calculation unit 18 is output to the control unit 19 in the same way as the total light emission described above was, so that it can be used for drive control.

Next, the control unit 19 performs the role of a control device for performing overall control of the operations of the video display apparatus of this embodiment. The control unit 19 controls the operation of the X-sustain driver 13 and Y-sustain driver 14 for driving the PDP 15. In this embodiment, the control unit 19 uses the total number of light emissions or the total amount of time the display is used that was obtained as described above in order to properly change the specified amount of drive for driving the PDP 15. It is possible for the control unit 19 to selective determine whether to use the total number of light emissions or the total amount of time in performing control. It is also possible for the user to select the method.

Next, detailed examples of methods used by the control 19 to control the specified drive amount for the X-sustain driver 13 or Y-sustain driver 14 according to the total number of light emissions or the total amount of time the display is used are explained. Here, a control method of changing the voltage value of the drive pulses (sustain pulses IPx, IPy and scanning pulse SP) for the X-sustain driver 13 or Y-sustain driver 14, and a control method of changing the timing at which the sustain pulses IPx, IPy are applied, are explained.

Figure 5:
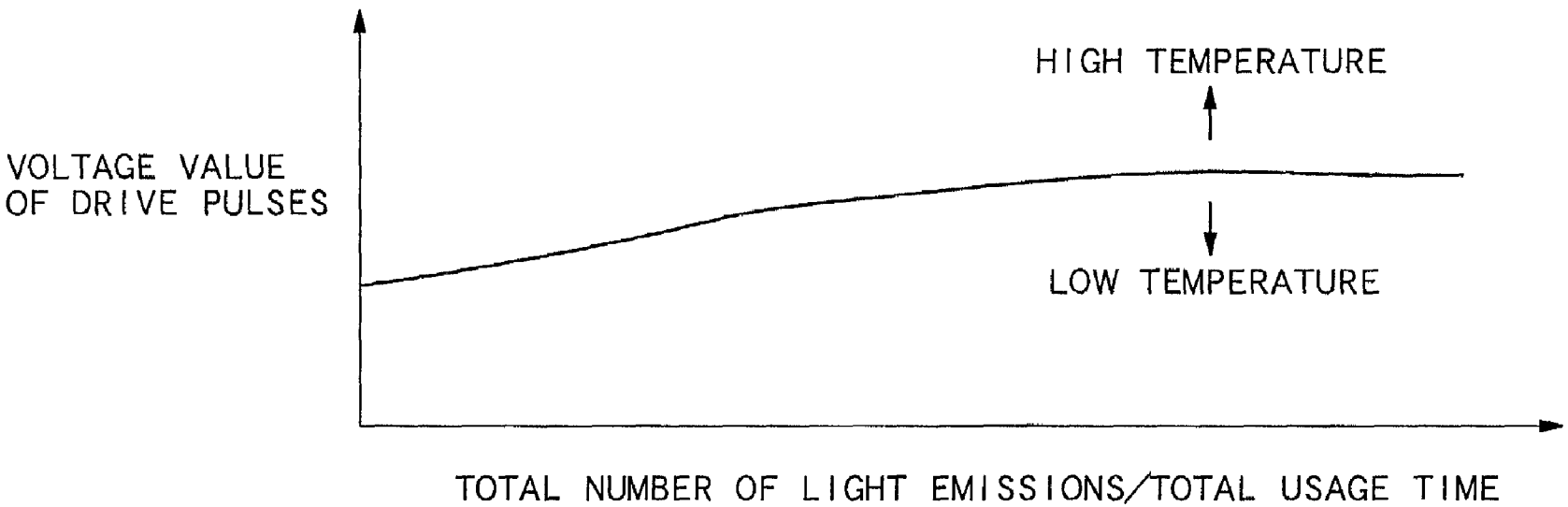
FIG. 5 is a drawing that shows an example of the control method for changing the voltage of the drive pulses for the X-sustain driver or Y-sustain driver according to the total number of times light is emitted or the total amount of time the display panel is used.

FIG. 5 shows one example of the control method of changing the voltage value of the drive pulses for the X-sustain driver 13 or Y-sustain driver 14, according to the total number of light emissions or the total amount of time the display is used. In the example shown in FIG. 5, as the total number of light emissions or the total amount of time the display is used increases, the voltage value of the drive pulse is gradually increased. When the discharge voltage of the discharge cells of the PDP 15 drop due to using the video display apparatus over a long period of time in this way, the voltage of the drive pulses are increased in order to compensate for that voltage drop. Therefore, it is possible to suppress degradation over time of the image quality of the video display apparatus. In the PDP 15,the discharge characteristics of each discharge cell change depending on the temperature condition, so, as shown in FIG. 5, for example, it is possible to perform control such that the voltage of the drive pulses is increased or decreased depending on the operating temperature condition.

The control unit 19 can holds the characteristics shown in FIG. 5 as a table in a specified memory, and read and set the voltages for the drive pulses for the X-sustain driver 13 or Y-sustain driver 14. In this case, the X-sustain driver 13 and Y-sustain driver 14 can be constructed such that the output voltage is controlled by an external setting.

Figure 6:
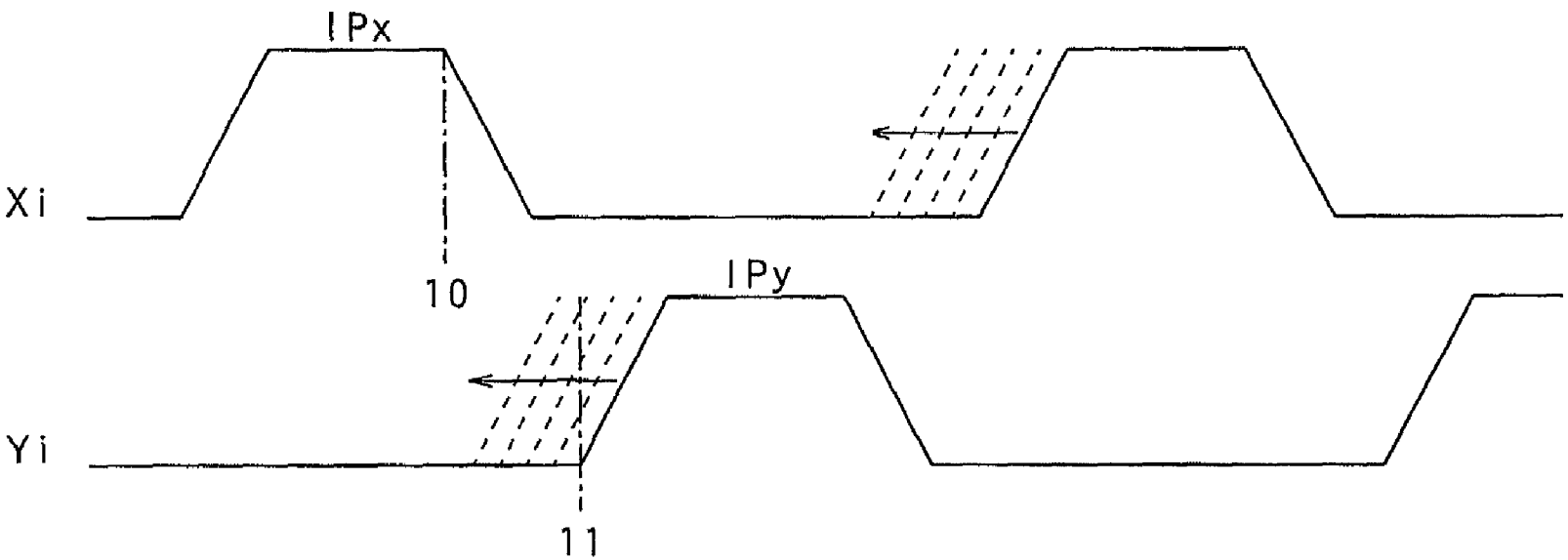
FIG. 6 is a drawing that shows an example of the control method for changing the timing for applying the sustain pulses IPx and IPy according to the total number of times light is emitted or the total amount of time the display panel is used.

Next, FIG. 6 shows an example of the control method of changing the timing at which the sustain pulses IPx, IPy is applied according to the total number of light emissions or the total amount of time the display is used. The example shown in FIG. 6 shows the case of changing the rise timing of the sustain pulses IPx, IPy according to the total number of light emissions or the total amount of time the display is used. As shown in FIG. 6, the sustain pulses IPx, IPy have a trapezoidal waveform pattern. One sustain pulse IPx, IPy is formed by changing from low level to high level at a specified rise time, then maintaining high level for a set time, and finally changing from high level to low level at a specified fall time.

As shown by the solid line in FIG. 6, in the initial stage, after a specified time after the fall timing t0 of the leading sustain pulse IPx, the rise timing t1 of the following sustain pulse IPy is set. As the total number of light emissions or total amount of time the display is used increases, the rise timing t1 of the following sustain pulse IPy comes earlier and approaches the fall timing t0 of the leading sustain pulse IPx. In this way, due to reasons that will be explained later, it is possible instantly increase the discharge voltage of the discharge cell based on the sustain pulse IPy, and thus it is possible to compensate for changes over time of the PDP 15 similar to the case of increasing the voltage of the drive pulses as described above.

FIG. 6 shows the case of controlling the rise timing of one sustain pulse IPx, however, the same effect can be obtained by control the rise timing of the other sustain pulse IPy. Also, instead of controlling the rise timing of the sustain pulses IPx, IPy, it is possible to control the fall timing such that the relationship between the sustain pulse IPx and sustain pulse IPy is as shown in FIG. 6. Moreover, it is possible to control the rise timing and/or fall timing of the sustain pulses IPx, IPy without changing the pulse width, such that the rising section of one sustain pulse has the same relationship with the falling section of the other sustain pulse as shown in FIG. 6.

Figure 7:
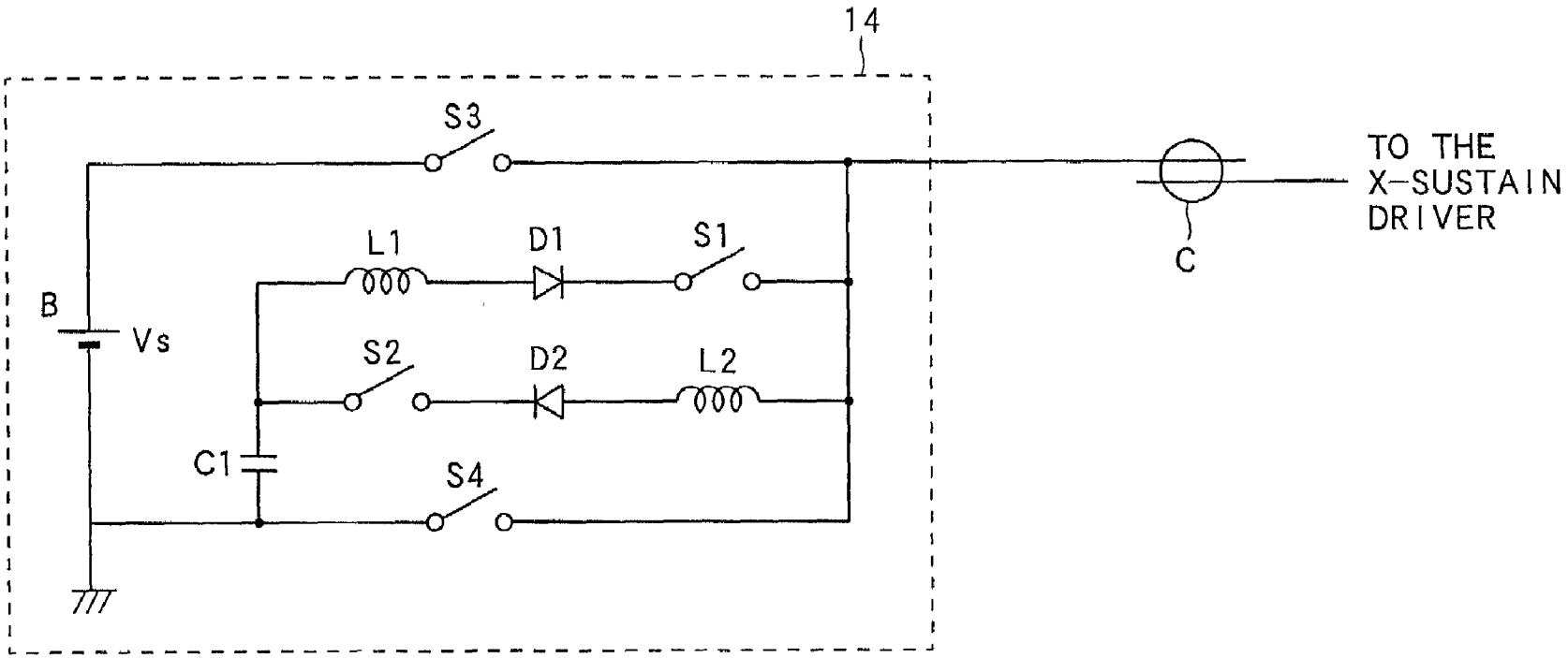
FIG. 7 is a drawing that shows a schematic of the outer circuit for the sustain pulse IPy of the Y-sustain driver.
Figure 8:
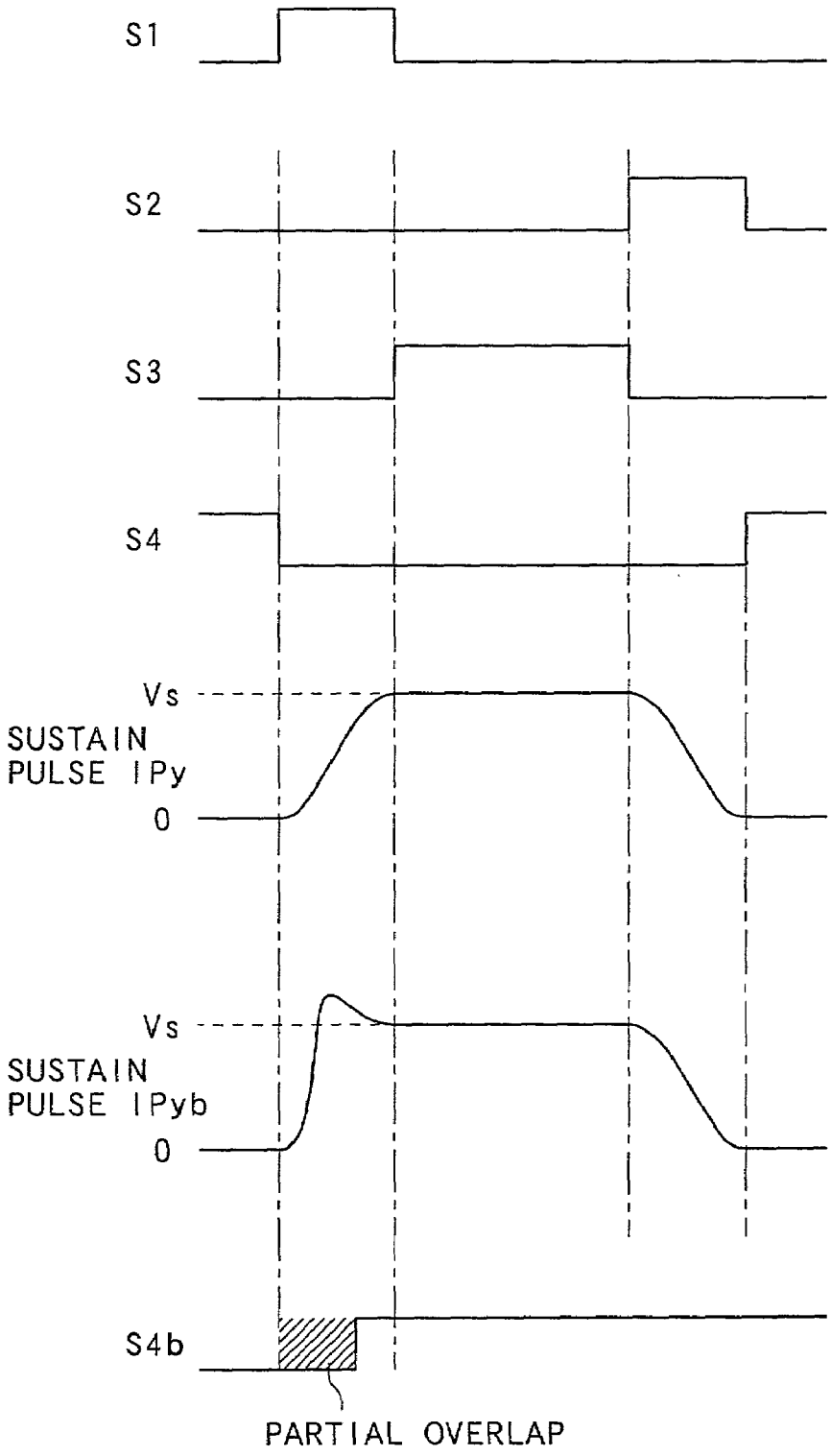
FIG. 8 is a drawing showing the waveform pattern of each component of the output circuit shown in FIG. 7.

Next, FIG. 7 and FIG. 8 will be used to explain the reason why the discharge voltage of the discharge cells instantly increase due to the sustain pulse IPy when the rise timing of the sustain pulse IPy becomes quicker as described above. FIG. 7 is a schematic drawing that shows the circuit configuration of the output circuit of the sustain pulse IPy of the Y-sustain driver 14. As shown in FIG. 7, the output circuit of the sustain pulse IPy comprises two coils L1, L2, a capacitor C1 and diodes D1, D2 to form a resonance circuit. With a voltage Vs supplied from the power supply B, the sustain pulse IPy is generated by controlling the opening and closing of four switches S1, S2, S3, S4. Also, the output circuit for the sustain pulse IPy is connected to a specified discharge cell of the PDP 15 via one of the sustain electrodes Y1 to Yn, and the output circuit for the sustain pulse IPx is connected to a specified discharge cell of the PDP 15 via one of the sustain electrodes X1 to Xn. It is not shown in FIG. 7, however, the output circuits for the other sustain pulses IPx have the same circuit configuration.

As shown in FIG. 8, the opening and closing of the switches S1 to S4 are controlled for the output circuit for the sustain pulse IPy that is constructed as shown above. In that way, the waveform of the sustain pulse IPy rises when the switch S1 is ON, maintains a voltage Vs when the switch S3 is ON, and falls when the switch S2 is ON based on the resonance operation of two coils L1, L2 and a capacitor C1. As shown in FIG. 8, during this time, the switch S4 remains OFF.

On the other hand, as shown in FIG. 6, the rise timing t1 of the sustain pulse IPy shown in FIG. 8 approaches the fall timing t0 of the leading sustain pulse IPx, and this case is shown as sustain pulse IPyb in FIG. 8. When that happens, as shown in FIG. 8, in the output circuit for the leading sustain pulse IPx, the period when the switch S4*b*, which corresponds to the aforementioned switch S4, is OFF, partially overlaps the period when the following sustain pulse IPyb rises.

Therefore, in the output circuit for the sustain pulse IPy, since the switch S4*b* of the output circuit for the sustain pulse IPx, which is connected via the capacitive discharge cell C, is grounded, the discharge current in the discharge cell C instantly increases due to the resonance characteristics. In this case, as shown at the bottom of FIG. 8, when the sustain pulse IPyb rises, it instantly exceeds the voltage Vs. Also, as the overlap of the period when the leading sustain pulse IPx falls and the period when the following sustain pulse IPy rises becomes longer, the change in voltage of the sustain pulse IPy becomes larger, so it is possible to increase the discharge voltage of the discharge cell C by just that amount.

The relationship of the actual amount of control to the total number of light emissions or total amount of time the display is used, and the timing at which the sustain pulses IPx, IPy are applied can be properly set in accordance to the circuit configuration and the discharge characteristics of the discharge cells. Also, in the control unit 19, similar to the voltage value of the aforementioned drive pulse, the control amount for the timing at which to apply the sustain pulses IPx, IPy can be held in a specified memory, and when driving the X-sustain driver 13 or Y-sustain driver 14 according to some specified conditions, control can be performed by reading values from a table.

In this embodiment, the case of using a plasma display panel (PDP) 15 as the display was explained, however, the invention is not limited to this and it can also be widely applied to a video display apparatus that uses other kinds of displays.

With the present invention as explained above, when driving a display panel, a specified control amount is controlled such that change over time of the display is compensated for based on the total number of light emissions or the total amount of time the display is used, so it is possible to prevent degradation of the image and to maintain good image quality when using the display panel for a long period of time.

The entire disclosure of Japanese Patent Application No. 2001-197294 filed on Jun. 28, 2001 including the specification, claims, drawings and summary is incorporated herein by reference in its entirety.

What is claimed is:

1. A drive method for a display panel that selectively applies a plurality of drive pulses corresponding to a gradation of an image based on an input image signal, said method comprising:

a calculation process of finding a multiplied product of a total number of sustain pulses applied in a field and an Average Picture Level value in said field, wherein, the total number of sustain pulses, which are determined according to a preset Automatic Brightness Limiter for said field, correspond to weighting given to respective sub-fields in said field for each cell of said display panel;

accumulating a total number of said multiplied product in each said field; and a control process of controlling a specified amount of drive in said field for said display panel based on said accumulated total number of said multiplied product for each said field in order to compensate for change over time of said display panel, wherein said control process controls a timing at which said drive pulses are applied to said display panel based on an accumulated total number of light emissions in order to compensate for change over time of said display panel, wherein said control process controls timings of sustain pulses in order that a rise timing of a following sustain pulse IPy comes earlier and approaches a fall timing of a leading sustain pulse IPx, and said IPx and said IPy are applied to a same cell in said display panel.

2. The drive method for a display panel according to claim 1 wherein said control process controls the timing at which said drive pulses are applied to said display panel based on a temperature condition and accumulated total number of light emissions in said field in order to compensate for change over time of said display panel.

3. The drive method for a display panel according to claim 1 wherein:

said calculation process calculates a total number of light emission in one field, multiplies the average brightness of said image in said field by the total number of said sustain pulses in said field, and accumulates said total number of light emissions in said field.

4. A drive apparatus for a display panel that selectively applies a plurality of drive pulses corresponding to the gradation of an image based on an input image signal, said apparatus comprising:

a calculation device that determines use time light is emitted at the time of a power supply on, and accumulates the total use time light is emitted at the time of a power supply on;

a detecting device that detects a temperature condition in which said display panel is used; and a control device for controlling a voltage of said drive pulses for said display panel based on the temperature condition and said accumulated total use time in order to compensate for change over time of said display panel, wherein said control device controls a timing at which said drive pulses are applied to said display panel based on an accumulated total number of light emissions in order to compensate for change over time of said display panel, wherein said control device controls timings of sustain pulses in order that a rise timing of a following sustain pulse IPy comes earlier and approaches a fall timing of a leading sustain pulse IPx, and said IPx and said IPy are applied to a same cell in said display panel.

5. The drive method for a display panel according to claim 4 wherein said control process controls the timing at which said drive pulses are applied to said display panel based on the temperature condition and said accumulated total use time in order to compensate for change over time of said display panel.

6. The drive apparatus for a display panel according to claim 4 wherein said control device controls the timing at which said drive pulses are applied to said display panel based on the temperature condition and said accumulated total use time in order to compensate for change over time of said display panel.

7. A drive apparatus for a display panel that selectively applies a plurality of drive pulses corresponding to the gradation of an image based on an input image signal, said apparatus comprising:

a calculation device which finds the number of emission times in one field for each of a plurality of cells of said display panel, and accumulates the total number of light emissions in each field;

a detecting device that detects a temperature condition in which said display panel is used; and a control device which controls a voltage of said drive pulses for said display panel based on the temperature condition and said accumulated total use time in order to compensate for change over time of said display panel, wherein said control device controls a timing at which said drive pulses are applied to said display panel based on an accumulated total number of light emissions in order to compensate for change over time of said display panel, wherein said control device controls timings of sustain pulses in order that a rise timing of a following sustain pulse IPy comes earlier and approaches a fall timing of a leading sustain pulse IPx, and said IPx and said IPy are applied to a same cell in said display panel.

8. The drive apparatus for a display panel according to claim 7 wherein said control process controls the timing at which said drive pulses are applied to said display panel based on the temperature condition and said accumulated total use time in order to compensate for change over time of said display panel.

9. The drive apparatus for a display panel according to claim 7 wherein:

said calculation device calculates the total number of light emission in one field, multi-plies the average brightness of said image in said field by the total number of said drive pulses in said field, and accumulates said total number of light emissions in said field.

10. A drive apparatus for a display panel that selectively applies a plurality of drive pulses corresponding to the gradation of an image based on an input image signal, said apparatus comprising:

a calculation device which determines an amount of use time light is emitted when power supply is on, and accumulates a total use time light is emitted when the power supply is on;

a detecting device that detects a temperature condition in which said display panel is used; and a control device which controls a voltage of said drive pulses for said display panel based on a temperature condition and said accumulated total use time in order to compensate for change over time of said display panel, wherein said control device controls a timing at which said drive pulses are applied to said display panel based on an accumulated total number of light emissions in order to compensate for change over time of said display panel, wherein said control device controls timings of sustain pulses in order that a rise timing of a following sustain pulse IPy comes earlier and approaches a fall timing of a leading sustain pulse IPx, and said IPx and said IPy are applied to a same cell in said display panel.

* * * * *

UNITED STATES PATENT AND TRADEMARK OFFICE

CERTIFICATE OF CORRECTION

PATENT NO. : 7,133,008 B2
APPLICATION NO. : 10/174821
DATED : November 7, 2006
INVENTOR(S) : Hideo Naganuma It is certified that error appears in the above-identified patent and that said Letters Patent is hereby corrected as shown below:

Claim 4, column 10, line 33, insert --that-- following “time”;
line 36, insert --that-- following “time”

Claim 5, column 10, line 55, delete “method” and insert --apparatus--
line 56, delete “process” and insert --device--;

Claim 7, column 11, line 13, delete “said” and insert --an--;
line 18, delete “an” and insert --said--;

Claim 8, column 11, delete “process” and insert --device--;

Claim 10, column 12, line 11, insert --that-- following “time”;
line 11, insert --that-- following “time”;

Signed and Sealed this

Twenty-first Day of August, 2007

JON W. DUDAS
*Director of the United States Patent and Trademark Office*